US005088933A

United States Patent [19]

Ribbeck

[11] Patent Number: 5,088,933

[45] Date of Patent: Feb. 18, 1992

[54] ELECTRICAL CONTACT ELEMENT

[75] Inventor: Horst Ribbeck, Wuppertal, Fed. Rep. of Germany

[73] Assignee: Stocko Metallwarenfabriken Henkels und Sohn GmbH & Co., Wuppertal, Fed. Rep. of Germany

[21] Appl. No.: 578,878

[22] Filed: Sep. 7, 1990

[30] Foreign Application Priority Data

Sep. 8, 1989 [DE] Fed. Rep. of Germany ..... 3929928

[51] Int. Cl.[5] ..... H01R 4/24

[52] U.S. Cl. ..... 439/395

[58] Field of Search ..... 439/389–425

[56] References Cited

U.S. PATENT DOCUMENTS 3,234,498 2/1966 Logan ..... 439/402
4,066,317 1/1978 Bierenfeld et al. .
4,088,382 5/1978 Ichimura ..... 439/397
4,405,193 9/1983 Weidler ..... 439/398
4,889,006 12/1989 Kolinske ..... 439/395

FOREIGN PATENT DOCUMENTS 0203639 12/1986 European Pat. Off. .
2168858 6/1986 United Kingdom .

*Primary Examiner*—Joseph H. McGlynn
*Attorney, Agent, or Firm*—Robert W. Becker & Associates

[57] ABSTRACT

An electrical contact element, which contacts by a cutting and clamping action, for an electrical wire plug connection consists of a forked spring, which has defined between its two flanks an introduction slot for the cutting and clamping contact of an electrical wire. The contact by cutting and clamping is improved by introducing a perforation into the flat forked spring, which is essentially the continuation of an introduction slot. An intermediate cross-piece remains between the introduction slot and the perforation.

3 Claims, 2 Drawing Sheets

ELECTRICAL CONTACT ELEMENT

Background of the Invention

The present invention relates to an electrical contact element, which contacts by a cutting and clamping action, for an electrical wire plug connection, which is to be arranged in a chamber of a plastic casing and is formed from a flat stamped sheet metal piece, wherein a flat forked spring has defined between its two flanks, which are elastic and deflect in the plane of the forked spring, an introduction slot for the cutting and clamping contact of an electrical wire, which consists of an electrical lead coated by insulation Electrical contact elements, which contact by a cutting and clamping action, for electrical wire plug connections are known. They are stamped from a metal sheet and are formed into the desired shape. An accordingly produced electrical contact element is then arranged in a respective chamber of a plastic casing of a wire plug connection. The contact to the respective electrical wire is then achieved by the cutting and clamping action of the electrical contact element. For this cutting and clamping action the electrical contact element is equipped with at least one forked spring, which defines, between its flanks, an introduction slot. The edges of the flanks, which are facing each other, are sharpened. In order to contact the electrical wire, the electrical wire is introduced into the introduction slot of the forked spring, whereby the edges of the flanks of the forked spring cut into the insulation of the wire such that the electrical contact is achieved between the flank edges and the electrical lead. Both flanks of the forked spring act with a clamping force on the electrical lead so that it is held in the introduction slot.

Since the flanks of the forked spring of the electrical contact element of the prior art are formed by stamping a slot, which opens at one end, into the plane of the metal sheet, the pitch of the spring flanks is small due to the short spring length and resulting lever action. The introduction of the electrical wire is rather difficult, because both spring flanks may only be bent to a small extent from their original positions, so that the width of the introduction slot may only be enlarged to a small extent. This is especially detrimental, when the same electrical contact element is used for electrical wires with electrical leads of varying diameters. Also, because of their low flexibility, the two flanks of the forked spring are not able to maintain a constant contact pressure, over an extended period of time, on the electrical lead of the wire, especially on stranded cables which lose their inner stability over time. The low pitch of the spring and the relaxation of the spring over time also cause a loss in contact pressure, and, in general, the contact by the cutting and clamping action of the known electrical contact elements on the electrical lead is imperfect.

It is therefore an object of the present invention to provide an electrical contact element, which contacts by a cutting and clamping action, for an electrical wire plug connection in which the contact by the cutting and clamping action on the electrical lead is improved.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
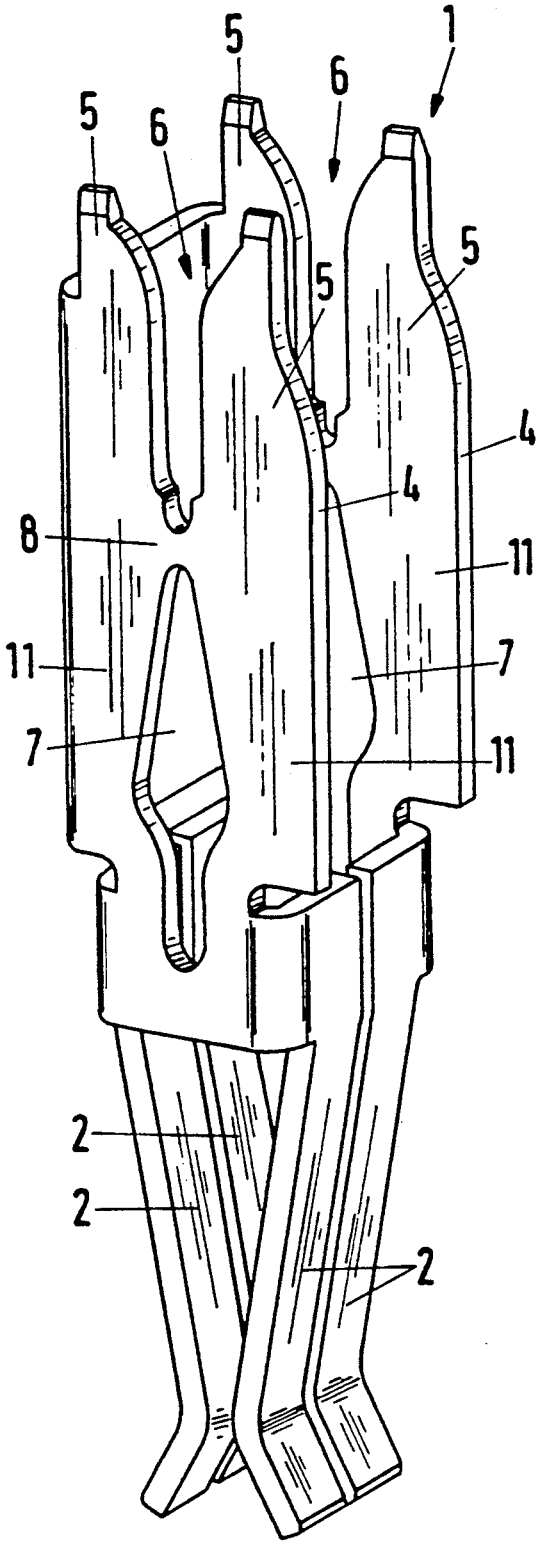
FIG. 1 is a perspective view of an electrical contact element.

The electrical contact element of the present invention is primarily characterized by a perforation in the flat forked spring, which is basically the continuation of the introduction slot, whereby an intermediate cross-piece remains between the introduction slot and the perforation of the forked spring.

The advantage of the electrical contact element according to the present invention is that, compared to the known forked springs of the prior art, the pitch of the spring and the flexibility of the spring flanks are increased while the clamping force remains the same, whereby the overall contact on the electrical wire by the cutting and clamping action is improved. This is a result of the additional perforation in the forked spring, whereby an intermediate cross-piece remains between the introduction slot and the perforation. Since the clamping force depends directly on the shape of the introduction slot and the build of the forked spring, which forms the boundaries of the introduction slot, but is independent of an additional perforation in the forked spring, the clamping force is not affected by the additional perforation and remains the same. However, the effective length of the spring is increased by the additional perforation in the flat forked spring, so that the respective flexibility of both spring arms is increased. As a result, the deflection of the spring arms and also the pitch of spring are increased. The additional perforation creates two points of rotation, respectively two joints. The first point of rotation, or pivot point, is in the area of the intermediate piece between the introduction slot and the perforation, and the second point of rotation, or pivot point, is in the area of the perforation on the end opposite the introduction slot.

Preferably, the perforation is symmetrical to the longitudinal axis of the introduction slot. This is advantageous, because both flanks of the forked spring then have the same effective configuration.

Preferably, the perforation extends close to the introduction slot. Thereby the point of rotation, or pivot point, in the area of the intermediate cross-piece of the forked spring allows for an optimal flexibility and also deflection of the spring flanks.

In order to maximize the effective spring length, the perforation is primarily formed as an elongated slot, which, in a further embodiment, may be formed pointedly with its pointed end facing in the direction of the introduction slot. The perforation then is essentially of a triangular shape. The other end of the perforation, facing away from the introduction slot, is also preferably tapered so that an optimal deflection behavior is achieved.

In another embodiment, the perforation is stamped out of the forked spring so that the electrical contact element of the present invention may be produced in a technically simple manner.

Another object of the present invention is an electrical wire plug connection with at least one electrical contact element, which is to be arranged in a chamber of a plastic casing and which is formed in the above-mentioned manner.

DESCRIPTION OF PREFERRED EMBODIMENTS

The present invention will now be described in detail with the aid of several specific embodiments utilizing FIG. 1 to 3.

Figure 2:
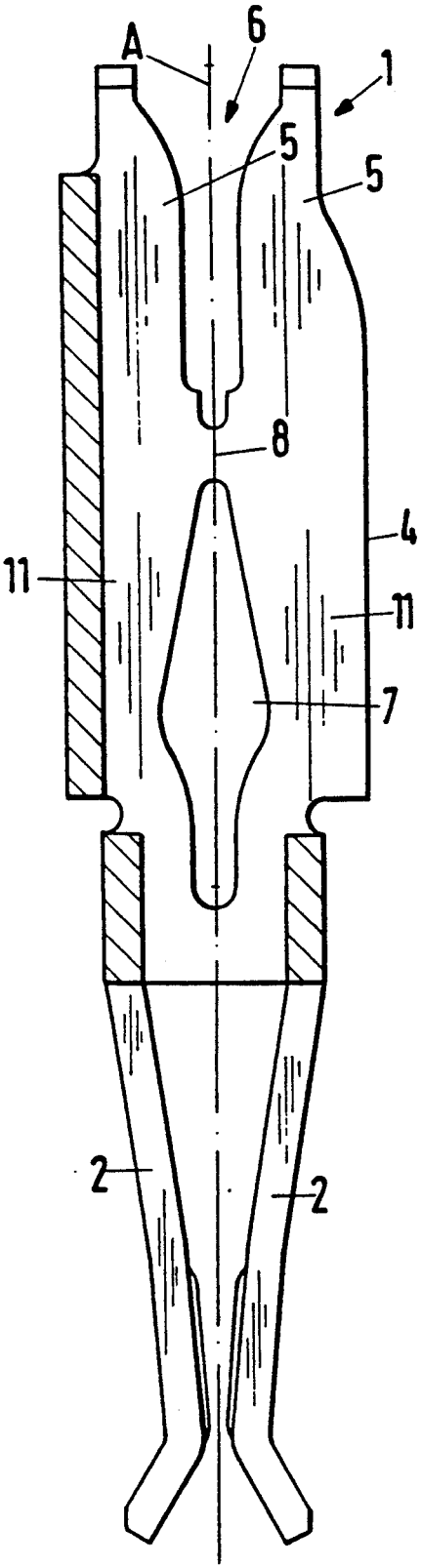
FIG. 2 is a cross-sectional view along the longitudinal axis of the electrical contact element in FIG. 1.
Figure 3A:
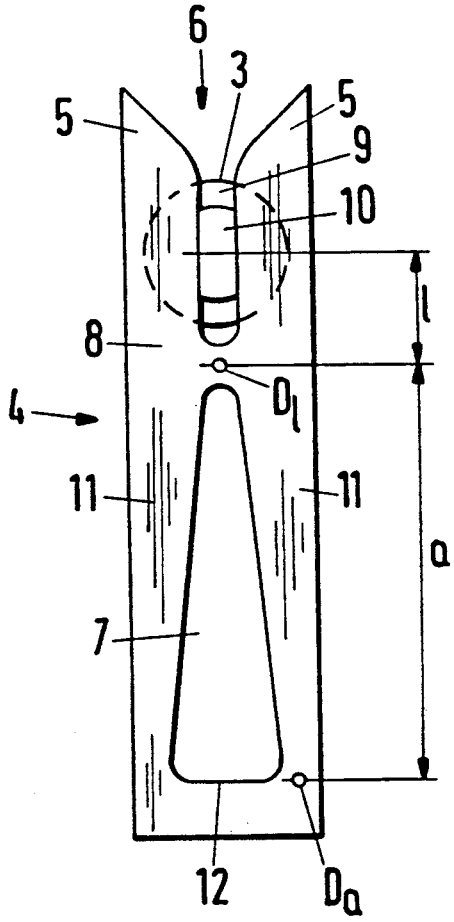
FIG. 3*a* is a schematic representation of a forked spring of the contact element according to the present invention with contacted electrical wires to demonstrate the physical actions taking place during the contacting step.
Figure 3B:
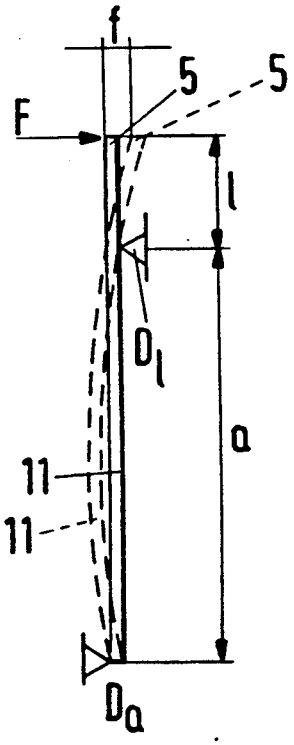
FIG. 3*b* is a schematic view of the forked spring of the contact element according to the present invention to demonstrate the bending action while the electrical wire is contacted.

The FIGS. 1 and 2 show on embodiment of the electrical contact element, which contacts by a cutting and clamping action, for an electrical wire plug connection, while FIGS. 3*a* and 3*b* demonstrate the special properties of the electrical contact element.

The electrical contact element 1 in FIGS. 1 and 2 consists of a stamped metal sheet piece, from which tho electrical contact element is formed by consecutive bending actions. The electrical contact element of FIGS. 1 and 2 is thereby produced from the flat stamped sheet metal piece.

This electrical contact element 1 is equipped with two pairs of spring shackles 2, between which, for example, the contact prong of a plug of an electrical plug connection is introduced to achieve electrical contact. The spring shackles 2 are shaped in a conventional manner.

In order to contact an electrical wire 3 by the cutting and clamping action of the electrical contact element 1, the electrical contact element 1 is equipped with two forked springs 4. Each one of the forked springs 4 consists of two spring flanks 5, which have defined between them an introduction slot 6 for the electrical wire 3.

The forked springs 4 also have an elongated slot-like perforation 7, which extends close to the introduction slot 6, whereby an intermediate cross-piece 8 remains between the introduction slot 6 and the perforation 7. The perforation 7 is pointedly shaped with its pointed end facing in the direction of the introduction slot 6 and may also taper off in the other direction.

As shown in the schematic drawing of a forked spring 4 in FIG. 3*a*, the electrical wire 3 is introduced into the introduction slot 6 in order to achieve a contacting connection. The two edges of the spring flanks 5, which are facing each other, cut into the insulation 9 of the electrical wire 3 until the spring flank 5 reaches the electrical lead 10 and thereby achieves contact.

The unique properties of the electrical contact element according to the present invention will be explained in detail in the following paragraphs with the aid of FIGS. 3*a* and 3*b*.

FIG. 3*a* represents a schematic drawing of a forked spring 4 of an electrical contact element 1, showing the introduction slot 6, the borders of which are formed by the spring flanks 5. Also shown is the perforation 7. The forked spring 4 has lateral spring flank sections 11 in the area of the perforation 7, which communicate with the respective spring flanks 5.

The clamping force F, with which the two spring flanks 5 press against the electrical wire 3, depends on the build of the spring flanks 5 as well as the shape of the introduction slot 6. However, the clamping force F is independent of the build of the additional perforation 7 so that the clamping force F is not influenced by it.

But the perforation 7 directly affects the flexibility of the spring flanks 5 and therefore the pitch of the spring f, as shown in FIG. 3*b*. The effective spring length, which defines the pitch of spring f and thereby the flexibility of the spring flanks 5, is determined by the dimensions 1 and a. In FIG. 3*b* the longest possible pitch of the spring f is represented by a dotted line. The dimension l is the effective length of the spring, if no perforation is present, as, for example in a conventional electric contact element. The length l is defined by the distance between the center of the intermediate cross-piece 8 and the center of the contacted electrical wire 3. The length a is defined by the distance between the center of the intermediate cross-piece 8 and the end of the spring flank sections 11, opposite the introduction slot 6, in the area of the base 12 of the perforation. The center of the intermediate cross-piece 8 defines the point of rotation, or joint, $D_1$. The end of the spring flank section 11, opposite the introduction slot 6, defines the point of rotation $D_a$ in the area of the base 12 of the perforation 7.

The bending behavior of the right spring flank 5 and the right spring flank section 11 of the forked spring 4 in FIG. 3*a*, when the electrical wire is contacted, is schematically represented in FIG. 3*b*. The spring flank 5 and the spring flank section 11 form a continuous spring, which, on one end (at the bottom in the drawing), is fixed by a pivot point $D_a$ and another pivot point $D_1$ on the other end (top of the drawing), in a distance to the first point of rotation $D_a$. The pivot points $D_a$ and $D_1$ represent the fixation of the spring flank when the spring is bent such that the spring flank section 11 is curved to the left, while the spring flank 5 is curved in the opposite direction, whereby a continuous transition between the spring flank section 11 and the spring flank 5 is achieved. Since the bending action of the spring flank section 11 in the area of its base, between the points of rotation $D_1$ and $D_a$ of the spring flanks 5 in the area of the bottom section of the introduction slot 6, has already taken place in the desired direction, the pitch of the spring f and the flexibility of the spring flanks 5 is thereby increased without affecting the clamping force F of the spring flank 5. The contacting action by cutting and clamping of the electric wire 3 is accordingly improved due to an increased flexibility of the spring flank 5 induced by the perforation 7.

The present invention is, of course, in no way restricted to the specific disclosure of the specification, examples and drawings, but also encompasses any modifications within the scope of the appended claims.

What I claim is:

1. An electrical contact element, which contacts by a cutting and clamping action, which electrical contact element is to be arranged in a chamber of a plastic casing and is formed from a flat stamped sheet metal piece, so as to have at least one flat forked spring, which has defined between two spring flanks thereof, which spring flanks are elastic and deflect in the plane of said forked spring, an introduction slot for the cutting and clamping contact of an electrical wire, which consists of an electrical lead coated by insulation; said electrical contact element further comprising:

a perforation in said flat forked spring for increasing a length of said flat forked spring, which perforation extends, spaced at a distance from said introduction slot, in a longitudinal direction of said electrical contact element, with an intermediate cross-piece being formed between said introduction slot and said perforation, whereby said perforation extends close up to said introduction slot so that said intermediate cross-piece is narrow, and with said perforation being essentially an elongated slot;

with said elongated slot being pointedly shaped with its pointed end facing in the direction of said introduction slot; and with said elongated slot being tapered at its other end facing away from said introduction slot.

2. An electrical contact element according to claim 1, in which said perforation is symmetrical to a longitudinal axis of said introduction slot.

3. An electrical contact element according to claim 1, in which said perforation is stamped out of said forked spring.

* * * * *